US011761621B2

(12) United States Patent
Bechter et al.

(10) Patent No.: US 11,761,621 B2
(45) Date of Patent: Sep. 19, 2023

(54) METHOD FOR FORMING A LUMINAIRE

(71) Applicant: ZUMTOBEL LIGHTING GMBH, Dornbirn (AT)

(72) Inventors: Wolfgang Bechter, Hittisau (AT); Michael Spiegel, Dornbirn (AT); Claudio Ender, Nenzing (AT)

(73) Assignee: Zumtobel Lighting GmbH, Dornbirn (AT)

( * ) Notice: Subject to any disclaimer, the term of this patent is extended or adjusted under 35 U.S.C. 154(b) by 0 days.

(21) Appl. No.: 17/794,074

(22) PCT Filed: Jan. 14, 2021

(86) PCT No.: PCT/EP2021/050629
§ 371 (c)(1),
(2) Date: Jul. 20, 2022

(87) PCT Pub. No.: WO2021/148291
PCT Pub. Date: Jul. 29, 2021

(65) Prior Publication Data

US 2023/0045853 A1 Feb. 16, 2023

(30) Foreign Application Priority Data

Jan. 20, 2020 (DE) ..... 10 2020 101 152.0

(51) Int. Cl.
*F21V 31/00* (2006.01)
*F21S 8/04* (2006.01)
*F21V 23/00* (2015.01)

(52) U.S. Cl.
CPC ..... *F21V 31/005* (2013.01); *F21S 8/043* (2013.01); *F21V 23/002* (2013.01)

(58) Field of Classification Search
CPC ..... F21V 31/005; F21V 23/002; F21S 8/043
See application file for complete search history.

(56) References Cited

U.S. PATENT DOCUMENTS

2017/0307204 A1 10/2017 Cattoni

FOREIGN PATENT DOCUMENTS

DE 202014004365 U1 9/2015
WO 2014086770 A1 6/2014

OTHER PUBLICATIONS

PCT/EP2021/050629, International Search Report and Written Opinion dated Apr. 13, 2021, 8 pages, and English translation, 7 pages.

*Primary Examiner* — Mary Ellen Bowman
(74) *Attorney, Agent, or Firm* — Andrus Intellectual Property Law, LLP

(57) ABSTRACT

The invention relates to a method for forming a luminaire (1), which has a trough-shaped luminaire housing (10, 110) having a region (25, 125) for accommodating illuminants, which is surrounded by a seal (40), a cover (70, 80) which spans the region (25, 125) and abuts the seal (40) in a peripherally closed manner, a frame-like holding element (50, 150), which presses the cover (70, 80) into abutment with the seal (40). For the luminaire housing (10 110), the cover (70, 80) and the holding element (50, 150), are each available in at least two different variants, which can be combined in any way, wherein in order to form the luminaire (1) according to desired output properties and/or properties with regard to heat dissipation or moisture resistance, a suitable luminaire housing (10, 110), a cover (70, 80) and a holding element (50, 150) are in each case selected and the selected components are assembled to form the luminaire (1).

14 Claims, 11 Drawing Sheets

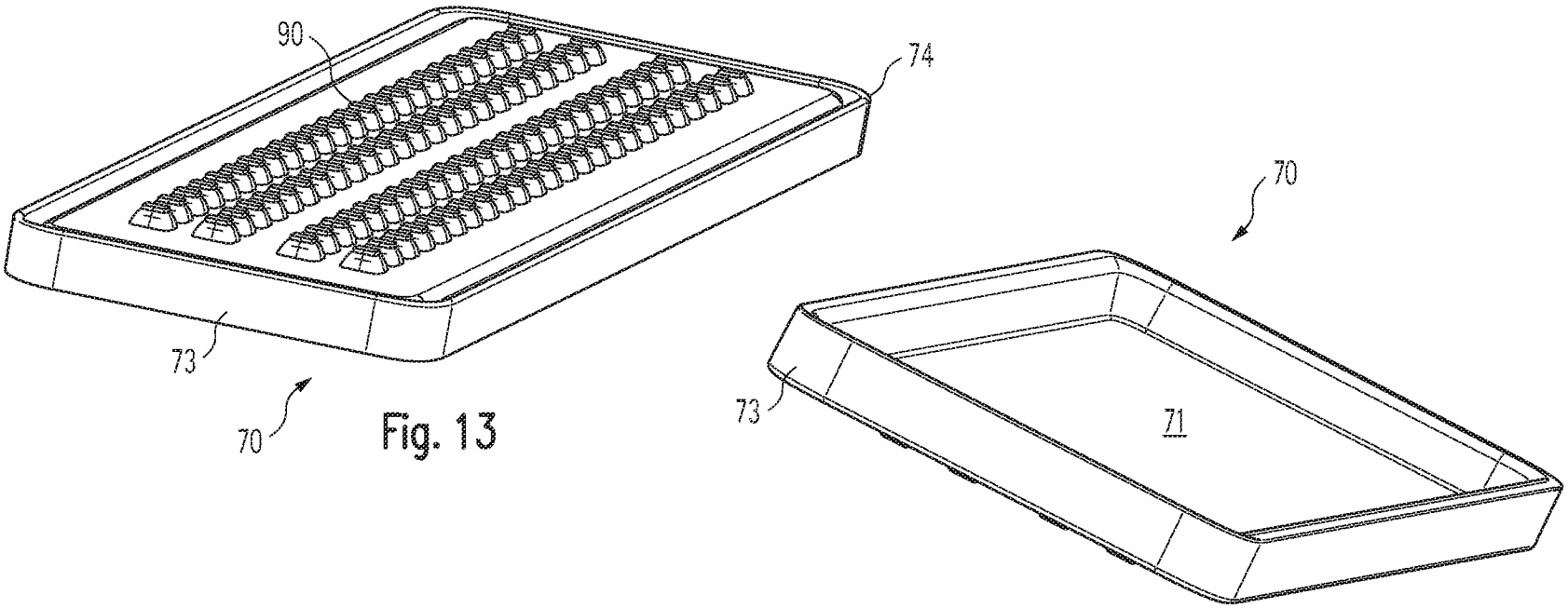
Fig. 13
Fig. 14
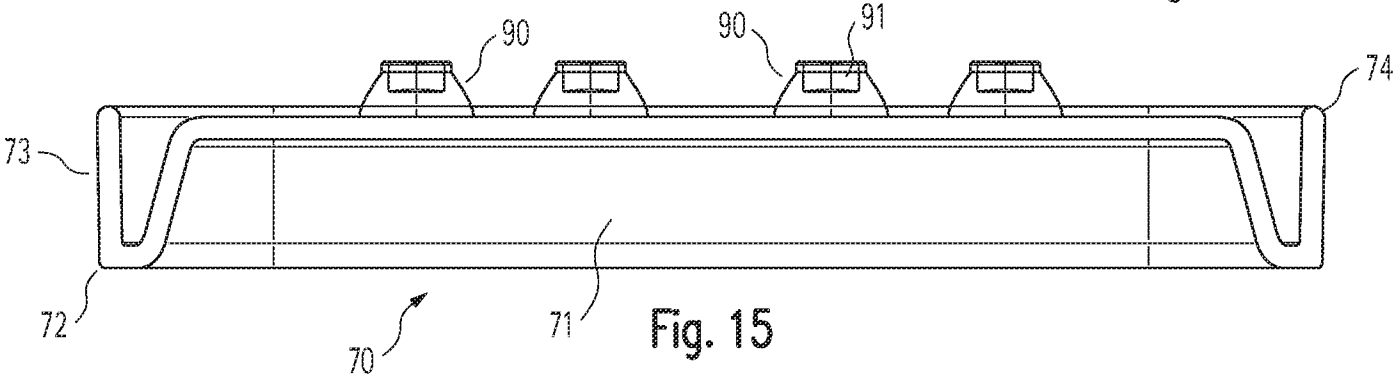
Fig. 15

METHOD FOR FORMING A LUMINAIRE

CROSS-REFERENCE TO RELATED APPLICATION

The present application is the U.S. national stage application of international application PCT/EP2021/050629 filed Jan. 14, 2021, which international application was published on Jul. 29, 2021 as International Publication WO 2021/148291 A1. The international application claims priority to German Patent Application 10 2020 101 152.0 filed Jan. 20, 2020.

TECHNICAL FIELD OF THE INVENTION

The present invention relates to a method for forming a luminaire, which has illuminants and operating components for operating the illuminants, which are to be efficiently protected from external influences. In particular, a so-called high-bay luminaire is to be formed by means of the method according to the invention.

BACKGROUND OF THE INVENTION

The term "high-bay luminaires" refers to luminaires that are used, for example, to illuminate larger halls or industrial complexes. In this application, the luminaires are typically mounted at a relatively large distance from the floor, which is why a requirement exists to the effect that the luminaire generates high-intensity light, which is then radiated onto the underlying area of a hall, for example. Accordingly, in such luminaires, relatively powerful illuminants are used, which must then be mounted in a suitable manner, taking care to ensure that the heat occurring during operation of the illuminants is dissipated in a suitable manner on the one hand and that the illuminants are protected on the other hand from external influences, in particular moisture and/or dust.

A luminaire of the type described above is known, for example, from WO 2014/086770 A1 of the applicant. The luminaire described therein is essentially formed by an aluminum die-cast body having expansive cooling-fin structures and cooling channels for dissipating the high heat generated during operation of the illuminants. Operating means are positioned centrally between two elongated LED arrangements, wherein the design of the die-cast body is such that air can flow around even a centrally arranged housing in which the operating means are accommodated, in order to enable sufficient heat dissipation. By using corresponding cooling-air openings, thermal decoupling between the housing for the operating means and the regions of the luminaire body in which the illuminants are arranged is also achieved to the greatest possible extent.

This luminaire known from the prior art has proven itself in many ways and is characterized by its excellent light output and at the same time high operational reliability. However, there are only a few possibilities for adapting the luminaire to special wishes with regard to desired output properties and/or with regard to efficiency in heat dissipation or protection against external influences. It would certainly be advantageous if greater, more cost-effective flexibility were to exist here, which opens the possibility of easily adapting the luminaire with respect to the aforementioned properties so that it is ultimately ideally adapted to the ambient conditions of the location at which the luminaire is to be used. The object of the present invention is to provide a corresponding solution for this purpose.

This object is achieved by a method for forming a luminaire having the features of claim 1. Furthermore, the object is achieved by a kit for forming a luminaire having the features of claim 2. Advantageous developments of the invention are the subject matter of the dependent claims.

SUMMARY OF THE INVENTION

According to the present invention, it is provided that the luminaire inter alia has the following three components, namely a trough-shaped luminaire housing having at least one region for accommodating illuminants, wherein the region is surrounded by a seal in a peripherally closed manner; a cover, which spans the region for accommodating the illuminants and abuts the seal in a peripherally closed manner in order to form a closed space with the luminaire housing, wherein the cover comprises an optical system for influencing the light of the illuminants; and a frame-like holding element, which is connected to the luminaire housing in such a way that it presses the cover into abutment with the seal. According to the present invention, it is thereby provided that the luminaire housing, the cover and the holding element are each available in at least two different variants, which, however, can be combined with one another in any way, wherein in order to form the luminaire according to desired output properties and/or properties with regard to heat dissipation or moisture resistance, a suitable luminaire housing, a cover and a holding element are in each case selected and the selected components are assembled to form the luminaire.

According to the present invention, a method for forming a luminaire is proposed, which has:

- a trough-shaped luminaire housing having at least one region for accommodating illuminants, wherein the region is surrounded by a seal in a peripherally closed manner, a cover, which spans the region and abuts the seal in a peripherally closed manner in order to form a closed space with the luminaire housing, wherein the cover comprises an optical system for influencing the light of the illuminants, and
- a frame-like holding element, wherein the holding element is connected to the luminaire housing in such a way that it presses the cover into abutment with the seal, wherein, according to the invention, the luminaire housing, the cover and the holding element are each available in at least two different variants, which can be combined with one another in any way, and wherein in order to form the luminaire according to desired output properties and/or properties with regard to heat dissipation or moisture resistance, a suitable luminaire housing, a cover and a holding element are in each case selected and the selected components are assembled to form the luminaire.

Furthermore, according to the invention, a kit for forming a luminaire is proposed, wherein the luminaire has:

- a trough-shaped luminaire housing having at least one region for accommodating illuminants, wherein the region is surrounded by a seal in a peripherally closed manner, a cover, which spans the region and abuts the seal in a peripherally closed manner in order to form a closed space with the luminaire housing, wherein the cover comprises
- an optical system for influencing the light of the illuminants, and a frame-like holding element, wherein the holding element is connected to the luminaire housing in such a way that it presses the cover into abutment with the seal, wherein the kit comprises for the luminaire housing, the cover and the holding element, at least two different variants each, which can be combined with one another in any way.

According to the invention, the three essential components of the luminaire—housing, optically effective cover and holding element—are each available in at least two different variants, which can however be combined with one another in any way. Ultimately, a luminaire can thereby be realized, which can be individually adapted to the respectively planned place of use of the luminaire with respect to the design of the housing, the output properties and, where applicable, the cover of the region of the devices for operating the illuminants. There is thus the possibility of forming a variety of differently designed luminaires, wherein the effort involved for this purpose is however relatively low. Ultimately, there are a variety of different combination options, all of which easily lead to a high-quality luminaire.

In a first step, it can be provided that the available variants of the luminaire housing differ in their material and/or the shape. Particularly preferably, it is provided here that a first variant of the luminaire housing is formed by a sheet-metal part, which is preferably provided in the form of a deep-drawn sheet-metal part. A second variant of the luminaire housing can then, for example, consist of aluminum and in particular be formed by an aluminum die-cast part. Both variants differ on the one hand with regard to production costs and on the other hand with regard to the possibility of influencing the shape of the housing in order to optimize the dissipation of heat. While the luminaire housing provided as a sheet-metal part can be produced relatively easily and inexpensively, the production costs for the housing in the form of an aluminum die-cast part are significantly higher, but a better heat dissipation can be achieved here. Depending on the environment in which the luminaire will be used, a correspondingly suitable housing can then be selected.

In the case of the luminaire housing, which consists of aluminum, it can furthermore be advantageously provided that substantially all surface regions of the luminaire housing that form outer surfaces of the luminaire housing are designed in such a way that in a mounted state of a luminaire that uses the luminaire housing, the drainage of a liquid via the outside of the housing wall and/or via an opening formed in the luminaire housing is enabled. This design has the result that liquid that forms on the outside or surface of the housing can immediately drain due to gravity and there is no risk of a greater amount of liquid accumulating and surface regions of the housing thus being exposed to a possibly chemically aggressive liquid over a longer period of time. This reduces the risk that corrosion occurs at certain surface regions due to such liquids and that the housing is ultimately damaged. The latter is significantly better protected against external influences due to these special advantageous measures, so that long-lasting use of the luminaire is ensured.

With regard to the available variants for the optically effective cover, it can also be provided that they differ in their material and/or the mounting of the optical system for influencing the light of the illuminants and/or the optical system itself. In a first variant, for example, it can be provided that the optical system itself is an integral part of the cover. A one-piece component is thus used here, which in turn can be produced relatively easily and inexpensively. In a second variant of the cover, on the other hand, it can be provided that the optical system is held as a separate component by the cover. This opens the possibility, for example, of using different optical systems or other light-influencing elements, such as color filters or diffusion disks, which are then selectively inserted into and held by the corresponding cover. The light output of the luminaire can thereby be specifically adapted to the desired output properties. Again, however, both variants of the cover are designed in such a way that they can be selectively combined with any variant of the housing and of the holding element.

Particularly preferably, it is provided that in addition to the accommodation region for the illuminants, the luminaire housing comprises, regardless of the selected variant, a further region for accommodating means for operating the illuminants, thus, for example, for accommodating operating devices such as converters or the like. The arrangement of batteries or accumulators or sensors in this region is also conceivable. The holding element preferably then comprises a further cover, which is designed to cover this further region separately from the accommodation region for the illuminants. In this respect, it can be provided that in a first variant of the holding element, the further cover is an integral part of the holding element. In a second variant of the holding element, on the other hand, it is in turn provided that the further cover can be detachably fastened as a separate cover element to the holding element, in particular by means of a screw connection. While the first variant of this holding element can be produced easily and inexpensively, the second variant again represents the more comfortable but somewhat more costly solution. In particular, it can be provided that the design is such that the separate cover element is detachable from the holding element in a state of the holding element fastened to the luminaire housing. This means that the cover element can be removed separately in order to perform repair or maintenance work in the corresponding accommodation region, in which the operating devices for operating the illuminants are located, for example. In this case, the further regions with the illuminants are however still protectively enclosed so that there is no risk of accidentally touching and/or damaging these illuminants A further advantage of the separate use of the cover element is furthermore that different variants of cover elements which are curved differently can be provided. Depending on which devices are to be arranged in the further accommodation region, a correspondingly suitable cover element can be used so that there is once again an additional possibility of adapting the configuration of the luminaire to the ultimately desired use.

Overall, an elegant possibility is thus created to adapt a luminaire in a very customized manner to the desired use. Nonetheless, a reliable and high-quality luminaire is obtained overall.

BRIEF DESCRIPTION OF THE DRAWINGS

The invention is explained in more detail below with reference to the accompanying drawing. Shown are:

FIGS. 13 to 15 are views of a first variant of an optically effective cover;

DETAILED DESCRIPTION OF THE PREFERRED EMBODIMENT

Figure 1:
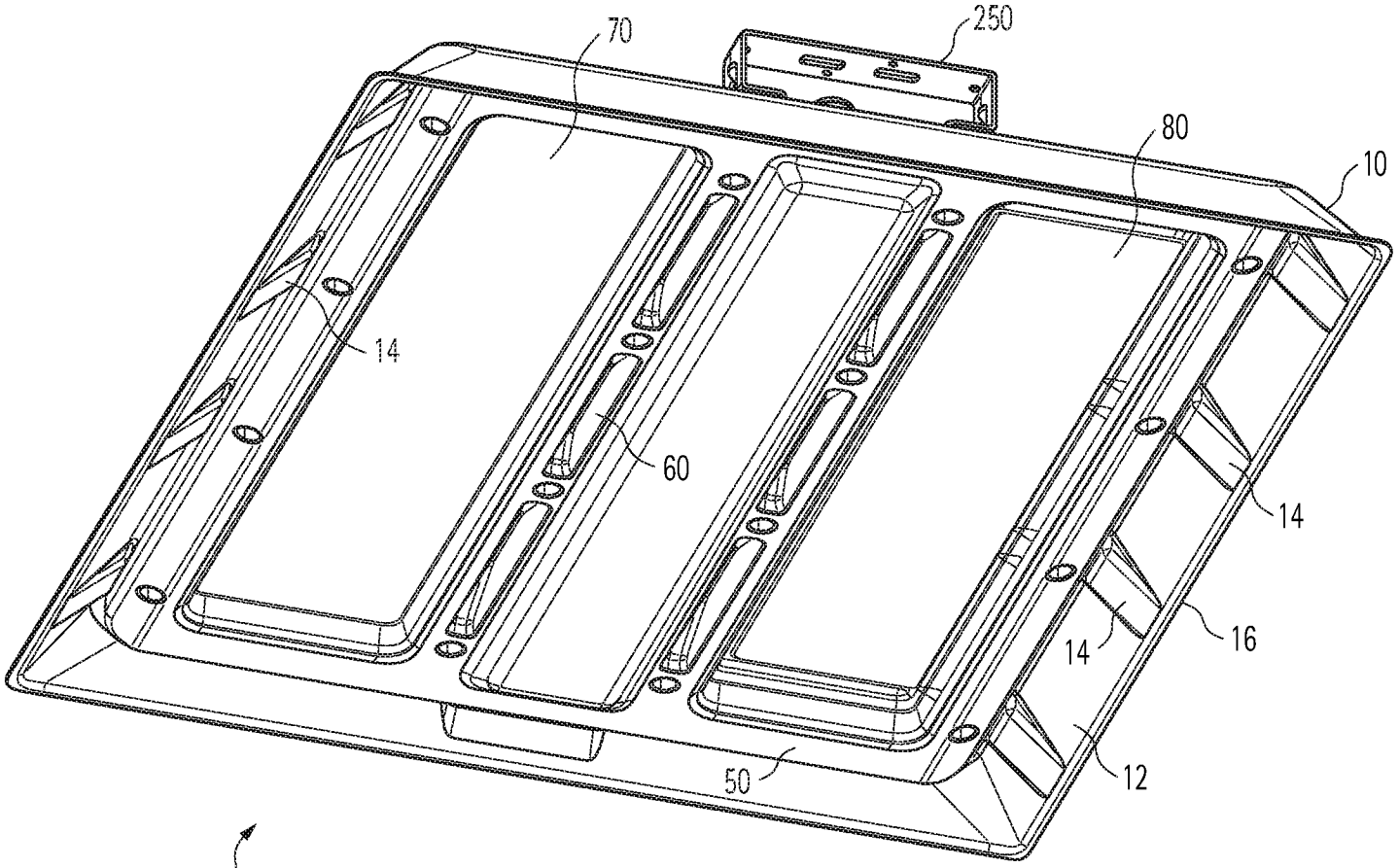
FIGS. 1 and 2 are views of a first variant of a luminaire, which can be realized by means of the method according to the invention.

The modular concept according to the invention for forming a luminaire is to be explained in detail below. FIGS. 1 to 4 initially show two different luminaire variants, which can be realized by means of the luminaire kit according to the invention. The further FIGS. 5 to 18 then show in detail individual components of this kit.

As already mentioned, the solution according to the invention is to be used to form a so-called high-bay luminaire, which is suitable as a relatively compact but powerful luminaire for use as a hall luminaire, for example. As with the luminaire described in WO 2014/086770 A1 of the applicant, it is thus provided that the ultimately created luminaire is arranged at a relatively large distance from the floor, wherein high-intensity light is to be generated, which is then radiated onto the underlying area, for example a hall.

Accordingly, the basic arrangement of the components responsible for light generation corresponds to the arrangement as also provided in the case of the luminaire of WO 2014/086770 A1. This means that one or more operating devices are positioned in a central region of the luminaire 1, wherein illuminants that are responsible for light generation and light emission are arranged on both sides of the central region. However, the concept according to the invention can also be applied to other luminaire forms, as will be explained later.

The essential components of the luminaire 1 according to the invention are a trough-shaped luminaire housing and a holding element 50, which is fastened to the luminaire housing and, where applicable, encloses, together with optical covers and a cover element, regions of the housing in which electronic components of the luminaire for light generation are arranged. These components are provided with reference signs 10 (housing), 50 (holding element) and 70 or 80 (optically effective cover) in the first luminaire variant, which is explained in more detail below. For clarification, the luminaire 1 shown in FIG. 1 contains both variants of the optically effective cover, on the left the first variant 70 and on the right the second variant 80, wherein, of course, identical optical covers are normally used for both sides.

Figure 2:
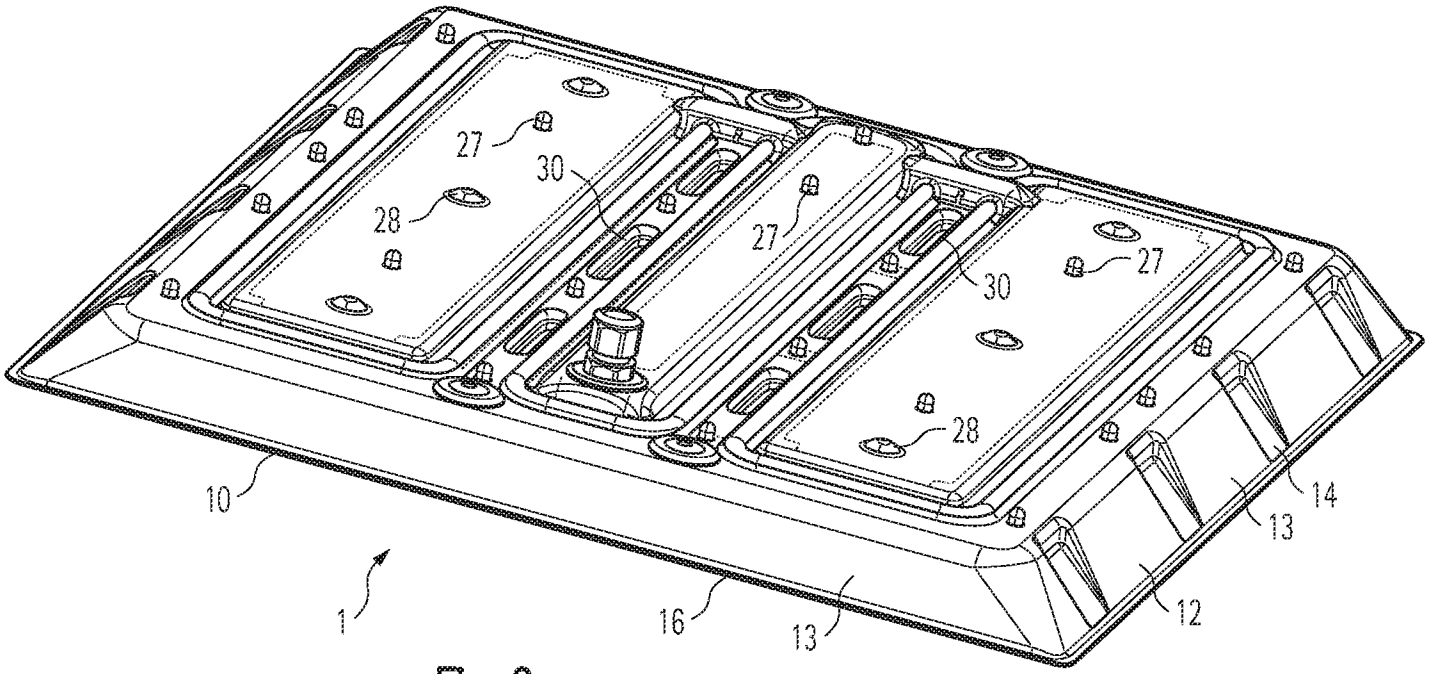

As with the luminaire in the prior art, the luminaire 1 shown in FIGS. 1 and 2 is thus also divided into three regions, namely a central region, which runs centrally along a longitudinal direction and serves to accommodate an operating device, and two light output regions, which are formed on both sides of the central region and in which the illuminants and the optical components associated with the illuminants are arranged for the light output. In the view according to FIG. 1, the light output thus takes place via two substantially rectangular lateral regions of the luminaire 1, via which high-intensity light is emitted.

A suspension or mounting of the luminaire 1 can be carried out according to the illustrated example by means of brackets 250, which are connected to the housing 10 on the two end faces of the central region on the rear side of the housing 10. The brackets 250 are designed in such a way that they allow suspension elements to be hung or fastened. Of course, other mounting solutions for the luminaire 1 are also conceivable.

First to be explained in greater detail below is the design of the luminaire housing 10, which constitutes a central component of the luminaire 1 according to the invention.

Figure 5:
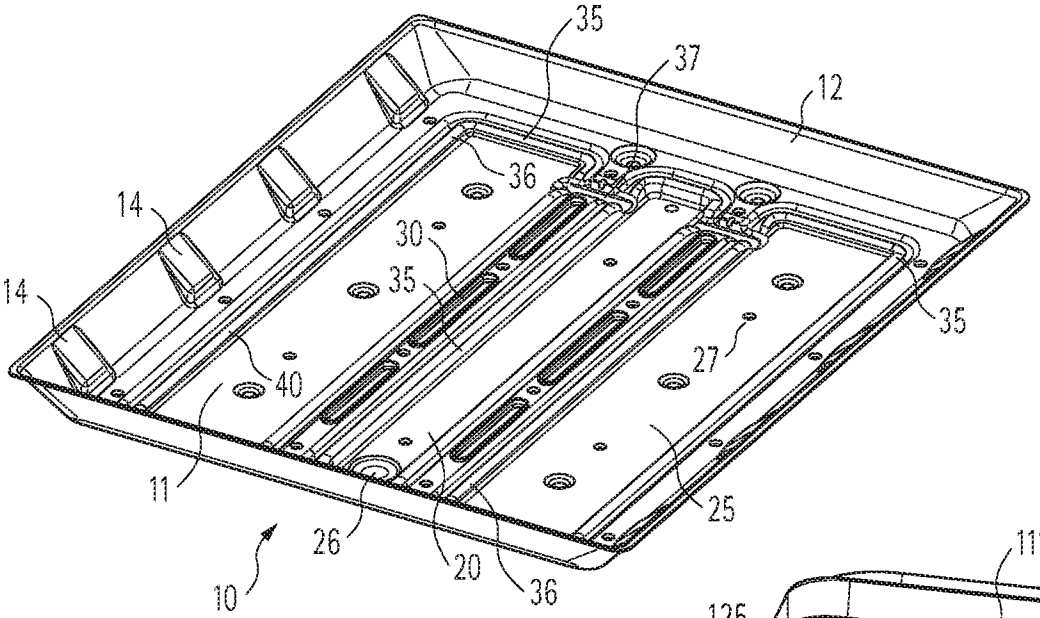
FIG. 5 is a first variant of a luminaire housing.
Figure 6:
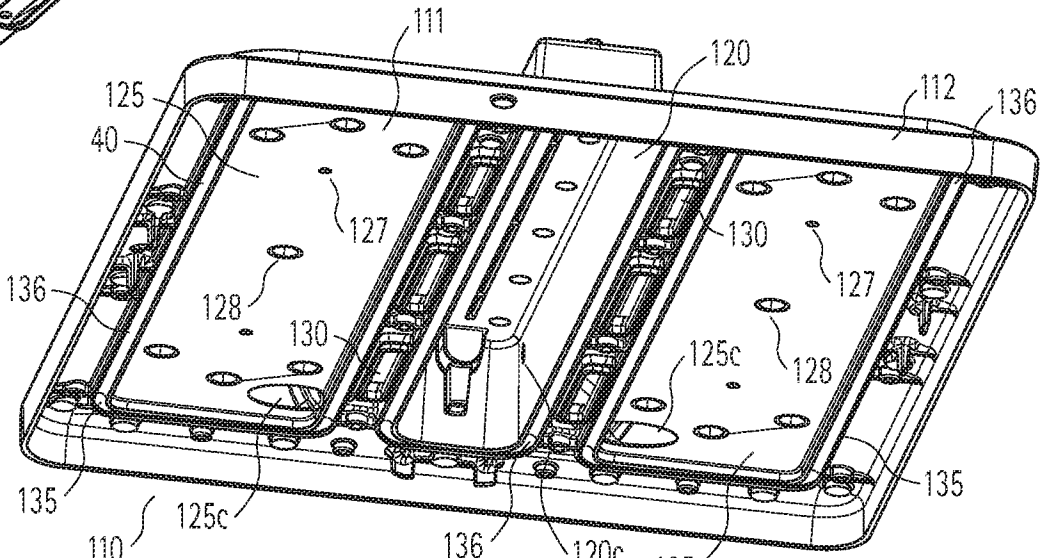
FIG. 6 is a second variant of a luminaire housing.

As can in particular be seen in the illustrations of FIGS. 1, 2 and 5, the luminaire housing 10 is designed to be trough-shaped with an approximately square housing bottom 11 in the illustrated exemplary embodiment, a laterally peripheral housing wall 12 extending from said bottom downward or in the light-emitting direction of the luminaire 1, wherein the housing bottom 11 and housing wall 12 delimit a luminaire chamber. The housing 10 is preferably made of sheet metal and is produced as part of a deep-drawing process so that it can be produced easily and inexpensively. The structural elements of the housing 10 described in more detail below can thus be formed relatively easily in a single work step; where applicable, a punching step can still be required before or after deep-drawing, in order to form the through-openings and further openings described in more detail below.

The primary task of the housing bottom 11 is to enable planar accommodation or mounting of the components of the luminaire 1 responsible for light generation and light output. Accordingly, the housing 10 is designed in such a way that on its side facing the interior of the housing 10, the housing bottom 11 forms three substantially planar regions, namely a central planar region 20 and two lateral planar regions 25. The central region 20 is provided for accommodating an operating device (not shown in the figures), for example in the form of a converter. With regard to its width, it is substantially adapted to the width of the operating device and is accordingly somewhat narrower than the two lateral accommodation regions 25. All three regions 20 and 25 are designed as defined indentations in the bottom 11 of the housing 10.

The two lateral accommodation regions 25 each serve to mount one or more LED boards, each of which forms an expansive light source. All three accommodation regions 20 and 25 are designed in this case to be planar, apart from the indentations described below, in order to enable a planar support of either the operating device or the LED boards. This enables the heat to be transferred to the housing bottom 11 during operation, thereby improving the cooling of the luminaire components or the heat dissipation.

The operating device and the LED boards can then be fastened to the luminaire housing 10 by means of a screw connection, for example, wherein the housing bottom 11 in the accommodation regions 20 or 25 is formed with knobs or blind-hole structures 27 that project outward with respect to the luminaire chamber. These blind-hole structures 27 are also created as part of the deep-drawing of the luminaire housing 10 and enable the threads of the screws to be cut into the respective sheet-metal material of the blind-hole structure when screwing in, and a secure fastening is thus achieved without the housing bottom 11 being penetrated by the screw. This solution is advantageous in that the housing bottom 11 can also be designed to be sealed in the region of the fastening of the luminaire components. In principle, however, it is also conceivable to subsequently weld or solder corresponding blind-hole structures to the housing bottom 11. The pressing of a corresponding component, which then enables the luminaire components to be screwed to the housing 10, is also conceivable, wherein the aim in all cases is preferably a solution which enables the luminaire interior chamber to be tight toward the outside in these regions.

Only the central accommodation region 20 additionally has, on an end face, a somewhat larger opening 26, via which a power supply cable for the power supply of the operating device can be guided. In this case, corresponding sealing measures, e.g., in the form of a grommet, are then provided on the rear side of the housing 10 and enable the sealed removal of the power supply cable (not shown in further detail) so that all three accommodation regions 20 and 25 are sealed toward the rear side in the assembled state of the luminaire 1.

An essential property of the luminaire 1 according to the invention furthermore consists in that the operating device and the LED illuminants are not arranged together in a single, tightly enclosed chamber, but that, instead, accommodation regions corresponding to the planar accommodation regions 20 and 25 are formed in each case and are each separately sealed and accommodate either the converter or the LED illuminants. The separate arrangement of these luminaire components in three separate chambers opens the possibility to thermally decouple the regions from one another on the one hand and to allow the flow of cooling air through the interstices between two adjacent accommodation chambers on the other hand.

It can be seen here that three elongated through-openings 30 in the housing bottom 11 are respectively formed on both sides of the central accommodation region 20 and are a component of the cooling-air channels described in more detail below, so that cooling air for the operating device can flow along both sides of the central accommodation region 20. The through-openings 30 are each delimited by a peripherally closed edge, which extends transversely to the portion of the luminaire housing 10 comprising said edge. The through-openings 30, which could of course also be designed differently with regard to their length and, where applicable, their shape, furthermore bring about a material reduction in the region between the central accommodation region 20 and the lateral accommodation regions 25 so that a certain thermal decoupling is present here and the risk is reduced that the heat generated by the LED illuminants is transferred to the region 20 comprising the operating device, for example.

The individual sealing of the three accommodation regions 20, 25 is enabled in that the corresponding regions 20 and 25 are each peripherally surrounded by an annular seal 40 (this seal is only shown for the left accommodation region 25 in FIG. 5), which cooperates with the holding element, which is described in more detail below, or with an optical cover. In the preferred embodiment shown, it is provided that the planar accommodation regions 20 or 25 are each peripherally surrounded by a raised and/or recessed ring structure, which is again integrally formed in a deep-drawing process and serves to accommodate the seal 40. In particular, it can be provided that each accommodation region is annularly surrounded by a shaft-like sealing structure 35, which forms a peripheral groove or indentation 36 in which the seal 40 is accommodated. The indentation 36 thus forms a peripheral channel into which the sealing material can be easily introduced. The latter can be a corresponding PU foam, for example, which can be injected into the indentation 36 in an automated manner as part of the production of the luminaire 1. It is advantageous here if the corresponding annular indentations 36 all extend within the same plane, as this facilitates the automated application of, for example, the liquid-applied PU foam for sealing.

The wave-like cross-sectional shape prevents a flowing away of the applied sealing material, which collects at the deep point of the wave-like sealing structure 35 and, accordingly, will harden easily there. However, as an alternative to the mentioned PU foam, other sealing materials or foams could also be used to realize the seal 40. For example, a strand of a corresponding sealing material could be inserted into the indentations 36. In principle, the use of so-called constructive sealing materials is also conceivable, wherein the shaft-like sealing structure 35 shown could then also be omitted, where applicable. The formation of a simple peripheral groove for accommodating the sealing material is also conceivable. However, the shaft-like structure also entails the further advantage that it leads to an additional increase in the stability of the trough body.

It is noted that, in spite of the peripheral sealing of the three accommodation regions 20 or 25, there must be an electrical connection between the central accommodation region 20 and the two lateral regions 25 in order to ensure that the operating device can supply power to the LED illuminants in a suitable manner. For this purpose, it is provided that on the side opposite the hole 26 for guiding the external power supply cable, the central region 20 is respectively connected on both sides to the two lateral regions 25 via a channel-like indentation 37 or a channel portion. These indentations 37 and channel portions, which run transversely to the sealing structures 35 and locally interrupt them, can then be used to guide the necessary lines or cables for the power supply of the LEDs from the operating device into the adjacent region 25.

Before explaining in detail below the sealing of the accommodation chambers on the basis of the cooperation of the luminaire housing 10 with the holding element 50 and the covers 70 or 80, the design of the peripheral housing wall 12 is explained in the following.

As already mentioned, this wall consists of four side wall regions 13 which extend from the housing bottom 11 and are designed as part of the deep-drawing process in such a way that they expand in a funnel-like manner away from the housing bottom 11 and thus in the light-emitting direction of the luminaire 1. The deep-drawing process advantageously results in that the side wall regions 13 transition into one another in one piece at the corners of the housing 10 and that no further measures for connecting the wall regions 13 are thus required. Structures 14 stabilizing the housing 10 overall can be embossed on the side wall regions 13. In order to be able to better cover these structures 14 and additionally increase the stability of the housing 10, it is furthermore provided that the peripheral housing wall 12 has, at its edge region, a peripheral rim 16 projecting horizontally outward. This rim 16 runs in a plane aligned in parallel to the plane of the housing bottom 11, and additionally gives the luminaire 1 a more harmonious overall appearance. Ultimately, the luminaire housing 10 thus fulfills numerous important functions of the luminaire 1 and can nonetheless be produced easily and inexpensively.

Figure 3:
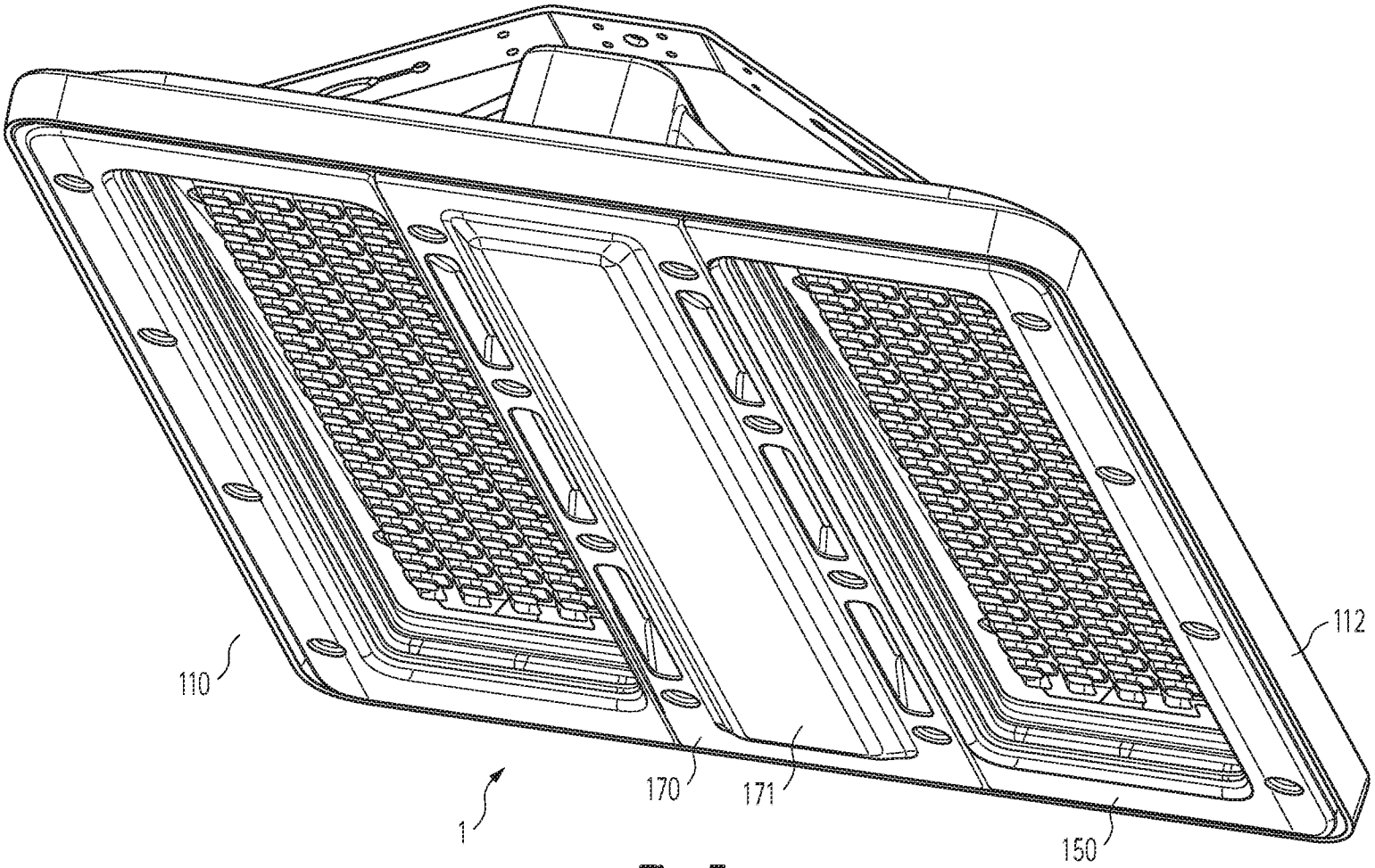
FIGS. 3 and 4 are views of a second luminaire variant, which can be realized by means of the method according to the invention.
Figure 4:
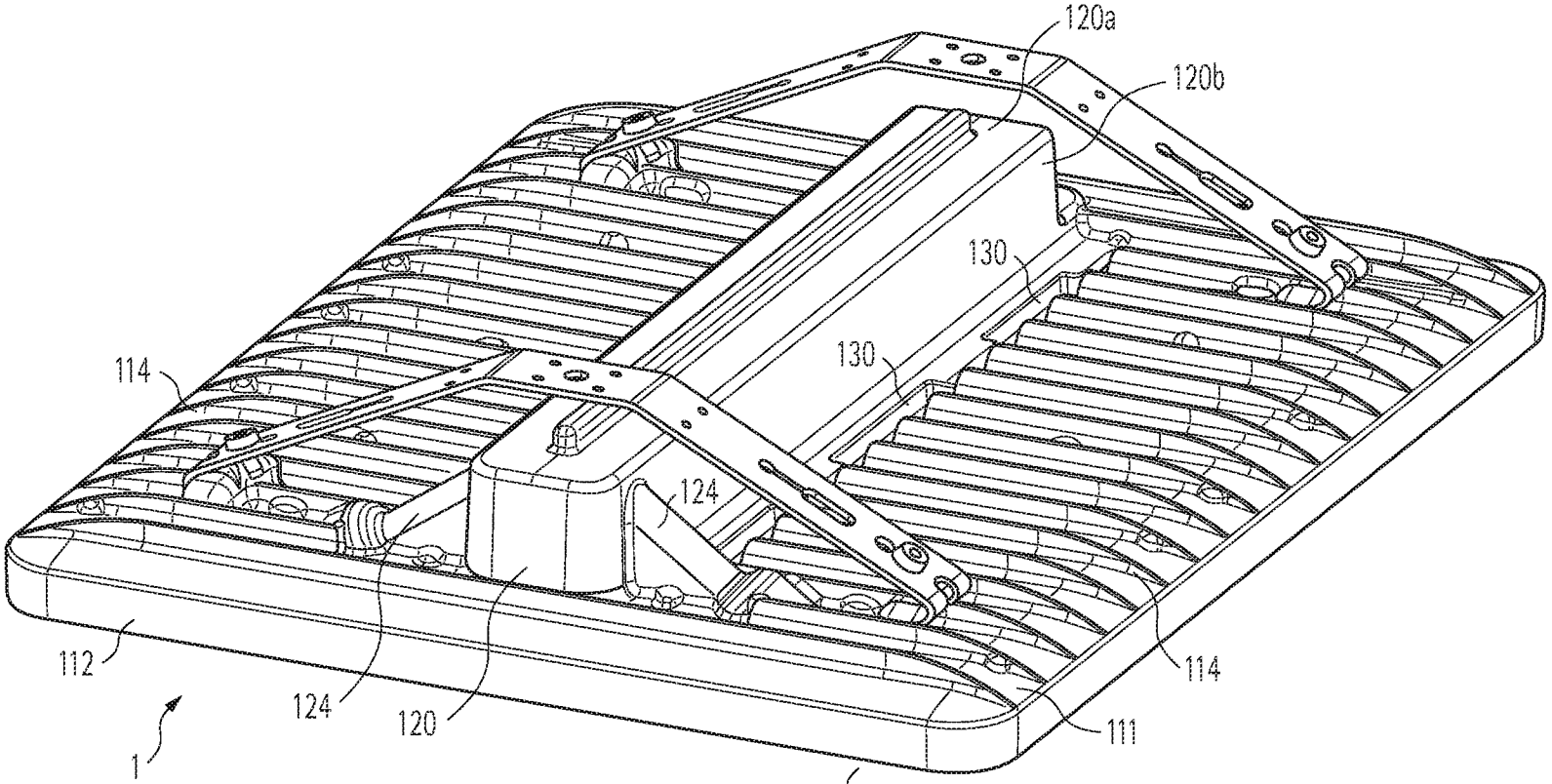

In comparison to the housing 10 of the variant of the luminaire 1 shown in FIGS. 1 and 2, a different luminaire housing 110 to be produced with greater effort is used for the second luminaire variant of FIGS. 3 and 4. This housing 110 is also designed to be trough-shaped, with a housing bottom 111, from which a lateral peripheral housing wall 112 extends downward or in the light-emitting direction of the luminaire 1, wherein the housing bottom 111 and 112 limit a luminaire interior, the dimensions of which are comparable to the luminaire housing 10 of the first variant.

However, the housing 110 is now preferably provided in the form of an aluminum die-cast body as the design of the housing 110 described in detail below can be realized more efficiently in this way. In principle, the use of other suitable materials is also conceivable if they enable a corresponding shape. Corresponding plastic materials are in particular also conceivable here, which would enable the production of the housing 110 as part of an injection-molding process in a comparable manner as aluminum but then must have a correspondingly sufficient stability and heat resistance.

In the same way as the first variant of the luminaire housing 10, the housing bottom 111 of the second variant also provides regions 120 and 125 for accommodating or mounting the components responsible for light generation and light output. In this respect, the planar lateral regions 125 for the illuminants are identical to those of the first housing variant 10 with regard to their dimensions. The central region 120, on the other hand, can now however be designed with a significantly deeper curvature in comparison to the two lateral accommodation regions 125 and in this case forms a cuboidal accommodation chamber, which projects on the rear side beyond the plane of the planar accommodation regions 125 but is again closed toward the rear side.

A further difference of the second housing variant 110 is that on the upper or back side of the housing 110, a plurality of cooling fins 114 running in parallel to one another are formed, through which a significant enlargement in the surface is created. Heat exchange with the ambient air is thereby facilitated so that improved heat dissipation is achieved in comparison to the first housing variant 10. The fins 114, which have a height of about 1 cm, extend transversely to the longitudinal direction of the three accommodation regions 120 or 125 and are, where applicable, interrupted by the accommodation region 120, projecting on the rear side, for the operating device.

A quite relevant problem of known luminaires of the illustrated type has so far been that they have been exposed to sometimes very high moisture, depending on the environment in which the luminaires were used. In particular, there was the risk that liquid would accumulate at certain regions of the surface of the housing. Due to external influences, this accumulating liquid could be quite chemically aggressive and affect the material of the luminaire housing, which could ultimately lead to the risk of corrosion and to damage to the luminaire as a whole.

According to the present invention, the second housing variant 110 is therefore designed in a special manner so that such problems can be avoided.

In particular, it is provided that substantially all surface regions of the housing 110 forming outer surfaces of the luminaire housing 110 are designed in such a way that the accumulation of larger amounts of liquid is prevented. For this purpose, it is provided that the mentioned surface regions are designed in such a way that liquid located thereon can basically drain due to gravity.

In particular, the rear surface regions of the housing 110 are raised, i.e., slightly convexly curved, which ultimately results in that substantially no planar surface regions but in particular no indentations are created on the rear side of the housing 110, which would enable liquid to accumulate. Instead, in principle, any sub-region of the outer surface of the housing 110 has, in comparison to the horizontal, a slope or curvature, even if a minor one, which results in that liquid can drain either laterally via the outsides of the housing wall 112 or via the through-openings 130 provided centrally in the housing 110.

Ultimately, no surface region of the luminaire housing 110 is thus covered with liquid over a longer period of time so that it is ruled out that the material of the housing 110 or a corresponding coating is thereby affected and that damage to the housing 110 ultimately occurs. This ensures permanent protection of the components located within the luminaire housing 110.

The aforementioned raising or sloping design of the surface regions may, where applicable, also relate to the upper edges of the already mentioned cooling fins 114. However, the latter are generally designed to be narrow so that no significant amount of liquid will accumulate here anyway. Accordingly, it is primarily to be ensured that the planar regions of the rear side of the luminaire housing 110 are designed in the manner described above. Even a slight slope of the rear side 120*a* of the accommodation region 120 for the operating device would be advantageous in order to also avoid the accumulation of liquid in this region.

The fastening of the LED boards is also carried out in the second housing variant 110 by means of a screw connection, wherein the housing bottom 111 in the corresponding accommodation regions 125 are again designed with indentations or blind-hole structures 127 projecting outward with respect to the luminaire interior. These indentations 127 are already created as part of the production of the luminaire housing 110 and thus enable secure fastening without the housing bottom 111 being penetrated by the corresponding screws. Further indentations 128 may then be used for corresponding insertion of positioning aids or the like, which ensure reliable alignment and fastening of the LED boards or the optically effective covers 70 or 80 described in more detail below.

A further difference to the first variant of the luminaire housing 10 is that in the second variant 110, openings 120*c* or 125*c* are provided on the bottom surfaces of the accommodation regions 125 or the side walls 120*b* of the central accommodation region 120 and represent end regions of two tubular connection channels 124, via which the lateral regions 125 are respectively connected to the central region 120. These channels 124 serve to easily lay connecting cables from the operating device arranged in the central accommodation region 120 to the illuminants located in the lateral regions 125. However, since these channels 124 are themselves tight toward the outside and only open in each case with their ends into the accommodation regions 120 or 125, this ultimately means that overall, the three accommodation regions 120, 125 are completely sealed toward the rear side by the housing 110, as is also the case analogously in the first variant of the housing 10.

In contrast to the first variant, however, the channels 124 run completely outside the ring structures, which surround the accommodation regions 120, 125 and are provided for accommodating the seal 40. These seal structures 135 having the annular indentations or channels 136 are also provided in the same manner in the second housing variant 110 since the sealing of the accommodation regions 120 or 125 takes place in the same manner as in the first variant 10. Again, the seal is only shown for the left accommodation region 125.

In the following, the sealing of the accommodation regions 20, 120, 25, 125 for the operating device and the LED illuminants is now explained in more detail. Although the housing variants 10 and 110 provide these three regions with correspondingly surrounding seals, it is necessary that these regions are covered appropriately in order to protect the luminaire components located therein from external influences, in particular dust and/or moisture.

Figure 7:
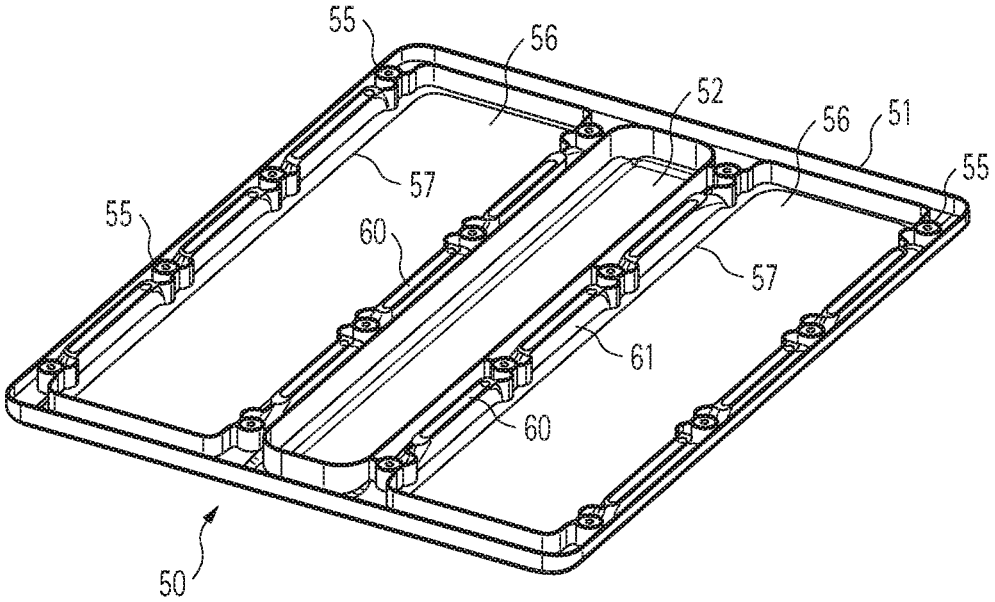
FIGS. 7 and 8 are views of a first variant of a holding element.
Figure 8:
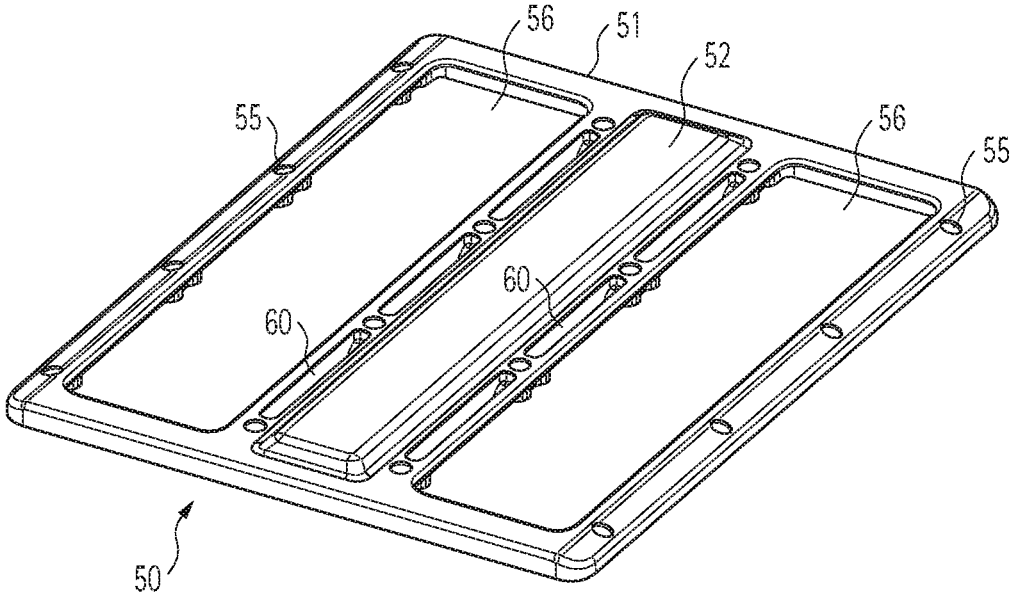

The already mentioned holding element, which is shown in a first variant in FIGS. 7 and 8, is responsible for this task. This variant is to be explained first in the following.

In the illustrated exemplary embodiment, the holding element 50 itself, however, only cooperates directly with the seal 40 surrounding the central accommodation region 20, 120 for the lamp operating device, while the accommodation regions 25, 125 for the LED illuminants, on the other hand, are sealed by optical systems or translucent covers, which are described in further detail below and are, however, mounted by the holding element 50 in such a way that they cooperate in a sealing manner with the corresponding peripheral seals.

As FIGS. 7 and 8 thus show, the holding element 50 initially consists of a peripheral frame 51, which approximately corresponds to the shape of the luminaire housing 10 and is thus square, and which is spanned in the central region by an approximately hood-like cover 52. This dome-like or hood-like cover 52 slightly projects in comparison to the plane of the underside of the frame 51, so that it forms a somewhat recessed accommodation chamber or a chamber. Of course, the height and width of the cover 52 can be adjusted as needed to the dimensions of the operating device and, where applicable, of further electrical or electronic operating components for operating the LED illuminants to be positioned in the region of the operating device. It is also conceivable to use an additional carrier so that the components accommodated in this region can be mounted in multiple planes. The decisive factor is that the hood-like cover 52 has on its region facing the housing bottom 11, 111, a peripherally closed edge 53 or a rim, which, in the assembled state of the holding element 50 on the luminaire housing 10, 110, contacts the seal 40, in particular dips into the flexible material of the seal 40. The central accommodation chamber is thereby jointly enclosed by the housing 10, 110 and the holding element 50 in a completely sealed manner so that the operating device is securely and reliably protected from external influences.

The fastening of the holding element 50 to the housing 10, 110 is carried out here via a plurality of screw connections, wherein the holding element 50, which is preferably produced in the injection-molding process, has corresponding openings 55 or cylindrical reinforcements with openings, which correspond to bores in the housing bottom 11, 111 of the luminaire housing 10, 110. The bores of the luminaire housing 10, 110 lie respectively outside the regions 20, 120 or 25, 125 to be sealed, for which reason simple bores or openings that completely penetrate the housing bottom 11, 111 can actually be used here. However, alternatively, the bores could again be provided on their rear side with the already described blind-hole structures. Furthermore, other through-openings or latching structures for preferably detachable fastening to the luminaire housing 10, 110 could also be selectively provided on the holding element 50 by means of separate fasteners, such as screws.

Figures 9, 10:
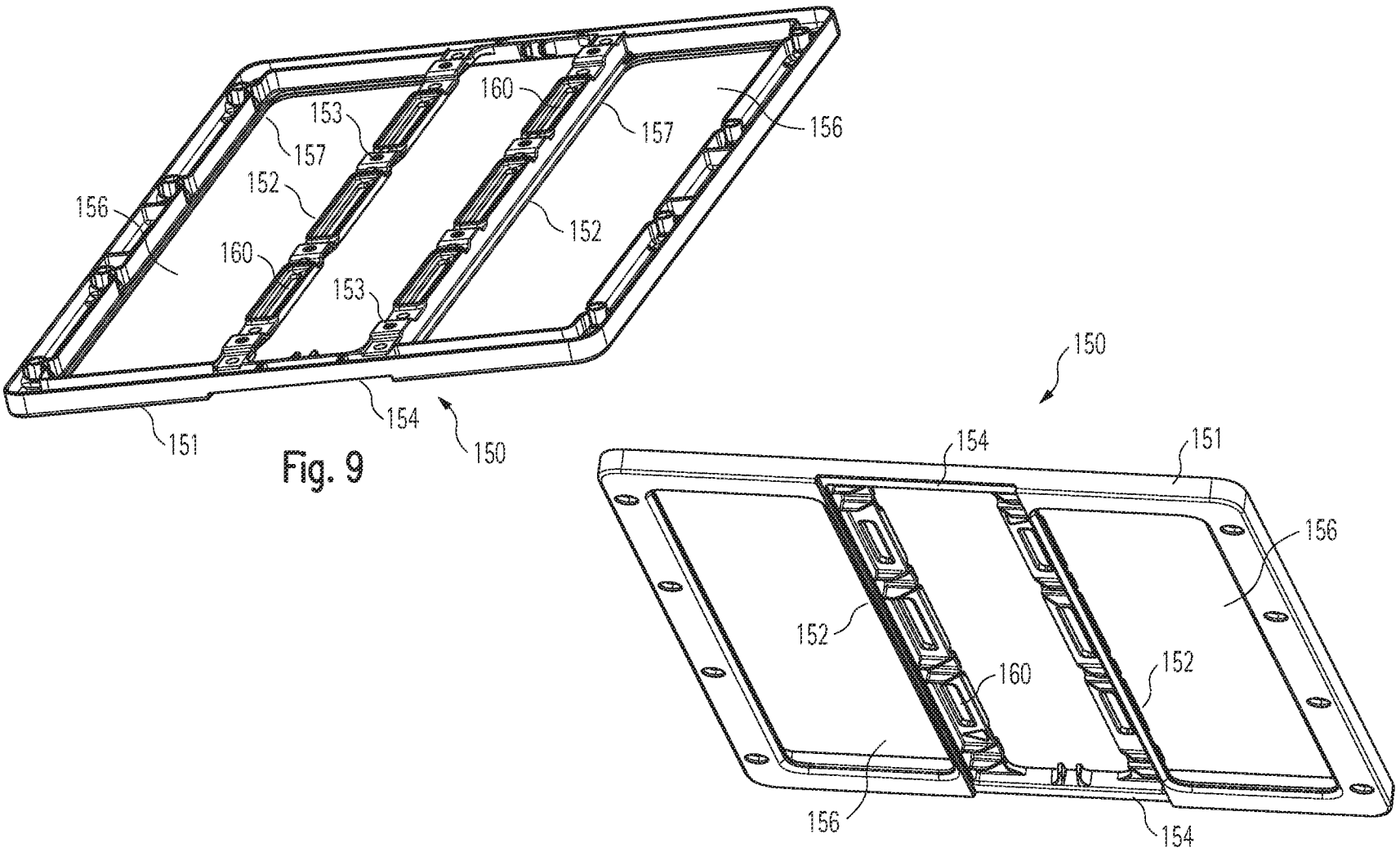
FIGS. 9 and 10 are views of a second variant of a holding element.
Figure 12:
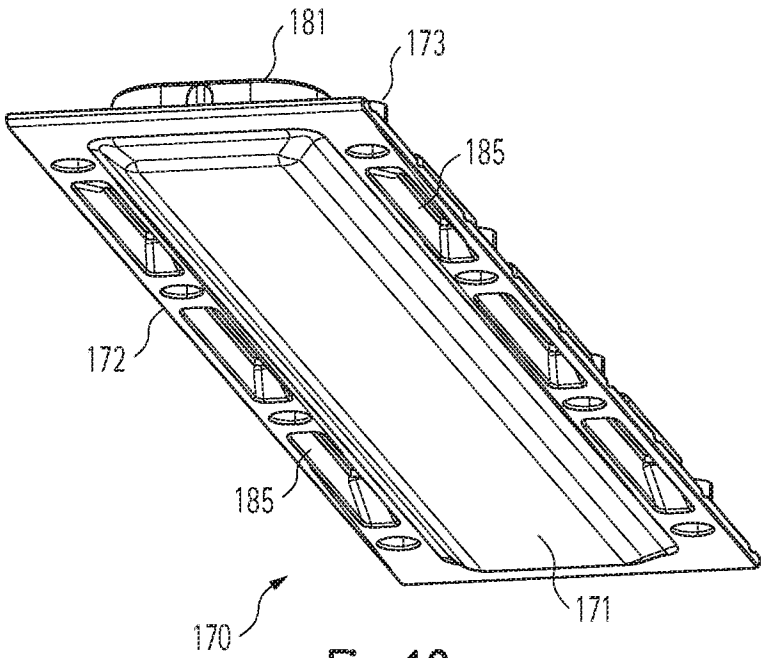
FIGS. 11 and 12 are views of a cover element, which can be combined with the second variant of the holding element.
Figure 11:
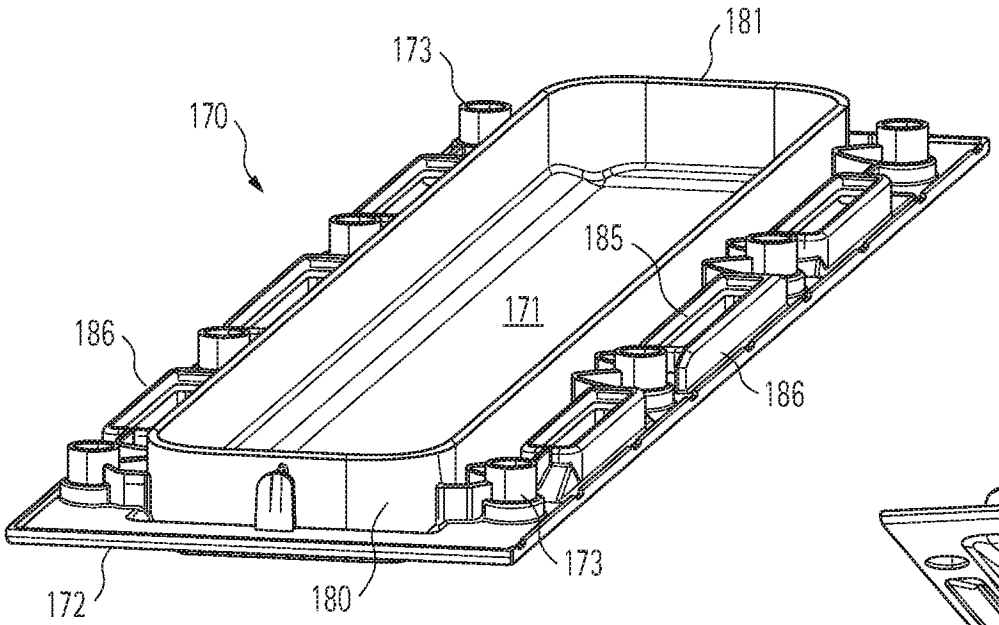

A second variant of a holding element 150 is shown in FIGS. 9 and 10. Unlike the first variant of the holding element 50, this second holding element 150 itself does not form a cover for the central accommodation region of the luminaire housing 10, 110 but instead serves to mount a separate cover element, which is shown in FIGS. 11 and 12.

Thus, as FIGS. 9 and 10 show, in this alternative variant, the holding element 150 in turn initially consists of a peripheral frame 151, which approximately corresponds to the shape of the luminaire housing 10, 110 and is thus rectangular or square, and which now however has no integral cover in the central region but instead only two connecting webs 152 that run in parallel to the longitudinal sides. These webs 152, which run in the region of the through-openings 30, 130 of the housing 10, 110 and thus on both sides of the central accommodation region 20, 120, then enable the fastening of a dome-like or hood-like separate cover element 170, which is shown in FIGS. 11 and 12. This cover element 170 is fastened to the holding element 150 by means of a plurality of screws, which pass through corresponding bores 153 or screw receptacles 173 in the webs 152 of the holding element 150 and the cover element 170. The screw connection is designed in such a way that even in the already assembled state of the holding element 150, only the cover for the central accommodation region 20, 120 can be opened and thus maintenance or repair work can be carried out separately in this region, where applicable. In this case, the protected arrangement of the illuminants in the lateral accommodation regions 25, 125 is then retained so that there is no risk of them being accidentally damaged or touched.

The cover element 170 has a dome-like or hood-like cover region 171, which is initially surrounded by a peripheral, flange-like web 172, wherein the already mentioned screw receptacles 173 for the screw connection to the holding element 150 are formed on the two longitudinal sides of this web 172. The two end-face regions of the web 172 are then accommodated in corresponding recesses 154 on the underside of the holding element 150, which recesses are dimensioned in such a way that in the bolted-on state of the cover element 170, the land 172 and the underside of the holding element 150 are in a common plane, as can in particular be seen in FIG. 3, which shows the holding element 150 and the cover element 170 in the assembled state fastened to the luminaire housing. Furthermore, a closed further web 180 extends from the outer circumference of the cover region 171 toward the rear side (and thus perpendicularly to the peripheral web 172) and forms a peripherally closed sealing edge 181.

In the mounted, i.e., bolted-on, state of the cover element 170, the dome-like or hood-like cover region 171 again projects slightly in comparison to the plane of the underside of the frame 151, so that said cover region forms a somewhat recessed accommodation chamber or a chamber that can be used to accommodate the operating device. In a comparable manner, additional components, such as batteries or accumulators for emergency lighting, sensors, such as presence sensors or brightness sensors, or comparable luminaire components may also be arranged, where applicable, next to the operating device in this variant.

It is also conceivable to optionally provide one or more further cover elements 170, the cover region 171 of which is curved more strongly and thus projects significantly beyond the holding element 150 and the housing 10, 110 of the luminaire 1 toward the underside. This not only creates a particularly large accommodation region for mounting a variety of operating components for the luminaire 1 but also opens up a possibility for mounting particularly temperature-sensitive components. This is because during operation of the luminaire 1, the most heat is emitted by the illuminants and this heat will however move upward so that components positioned below this plane of the illuminants are better protected against overheating.

For sealing the central accommodation region 20, 120, it is a decisive factor that the cover element 170, at its region facing the housing bottom 11, 111, now has the peripherally closed rim 180 with the sealing edge 181, which in the state of the holding element 150 mounted on the luminaire housing 10, 110 and in the bolted-on state of the cover element 170, contact the seal 40, in particular dips into the flexible material of the seal 40, analogously to the sealing edge 53 of the first holding element 50. Analogously to the previously described variant, the central accommodation chamber is enclosed in a completely sealed manner by the housing 10, 110 and the holding element 150 with the cover element 170 screwed thereto, so that the operating device and any other components mounted in this region are securely and reliably protected from external influences.

With regard to its further properties, in particular with regard to the mounting of the optically effective covers 70 or 80 discussed below, as well as the through-openings for the cooling-air channels, the holding element 150 shown in FIGS. 9 and 10 then corresponds to the holding element 50 already previously described. That is to say, the combination of the holding element 150 and the separate cover element 170 may be used as a full-fledged replacement for the holding element 50 described above.

However, the significant advantage now lies in that by unscrewing the cover element 170, the cover for the central accommodation chamber can be opened at least temporarily in order to possibly perform repair or maintenance work, whereas, on the other hand, the holding element 150 may continue to remain on the luminaire housing 10, 110 and the illuminants are accordingly still appropriately protected.

Furthermore, the two-piece variant of the holding element 150 with the cover element 170 opens the possibility of using different materials for the two components. This may be advantageous if, due to the area of use of the luminaire, certain materials are to be deliberately used in order to, for example, adapt the possibility of the luminaire for heat dissipation and/or its chemical resistance accordingly. Ultimately, this variant therefore allows more flexibly determined, individual properties to be assigned to the luminaire.

A sealing corresponding to the previously described cooperation between the cover 52 or 170 and the seal 40 for the central accommodation region 20, 120 is also provided for the two accommodation regions 25, 125 for the LED illuminants, wherein, however, the holding element 50, 150 in the exemplary embodiments shown does not itself come directly into contact with the seals, but this function is rather fulfilled by a translucent cover 70 or 80 in each case.

These covers 70, 80 are accommodated in the region of the openings 56, 156 of the frame 51, 151, which are formed on both sides of the hood-like cover 52 or cover element 170 and ultimately form the light-emitting openings of the frame-like holding element 50, 150, and are held and positioned by the holding element 50, 150 in such a way that they can cooperate with the seals 40.

The figures show two different variants of the translucent covers 70, 80, which are in each case shown individually in FIGS. 13 to 15 and 16 to 18. In both cases, the cover is also used to influence the light emitted by the LEDs or the mounting of a corresponding optical system.

In principle, in both variants of the hood-like or dome-like cover 70 and 80, it is again provided that a planar light output region 71, 81, which is peripherally surrounded by a U-shaped rim 72, 82, which has a leg 73, 83 that tapers off toward the seal 40, a transverse connecting leg, and an inner leg connecting the connecting leg to the rest of the cover 70, 80, wherein the U-shape on the one hand increases the stability of the cover 70, 80, and the outer leg 73, 83, is on the other hand oriented upward and forms a sealing edge 74, 84 which is peripheral in a plane. The function of this sealing edge 74, 84 is comparable to the edge 53 of the cover 52 or the edge 181 of the cover element 170. That is to say, in the assembled state, the edge 74 or 84 dips into the peripheral seal 40 at the housing bottom 11, 111 of the luminaire housing 10, 110, and thereby completely encloses the corresponding accommodation region 25, 125 for the LED illuminants. In this case as well, a chamber enclosed in a completely sealed manner is thus obtained, in which the LED illuminants are now accommodated.

The mounting or positioning of the cover 70 or 80 required for this purpose is realized by the holding element 50, 150, which has an inward projecting support edge 57, 157 or a support web surrounding the two openings 56, 156. In the mounted state, the covers 70 or 80 are then floating with their lower edge of the U-shaped rim 72 on the support edge 57, 157, wherein the dimensions of the holding element 50, 150 are selected in such a way that it is ensured that the cover 70 or 80 cooperates with the respective seal 40 in an actually sealing manner. The support edge 57, 157 extends in a plane transversely or orthogonally to a pressing direction for pressing the cover 70, 80 into abutment with the seal 40. Instead of the peripherally closed support edge 57, 157 shown, support regions could also be provided in section and are then distributed, preferably evenly, around the circumference of the openings 56, 156.

However, some play in the mounting of the cover 70 or 80 is desired to the extent that slight transverse displacements due to different coefficients of temperature expansion in the materials of the luminaire 1 can thereby be absorbed. In the illustrated exemplary embodiment, the cover 70 or 80 is thus not rigidly connected to the holding element 50, 150 or the luminaire housing 10, 110. Instead, when the luminaire 1 is assembled, only the cover 70 or 80 is inserted into the holding element 50, 150 accordingly and then screwed to the luminaire housing 10, 110 in the manner previously described.

The two variants of the cover 70 or 80 shown in FIGS. 13 to 18 differ primarily with respect to the mounting of further optical elements, which are provided in order to influence the light emitted by the LED illuminants. In both cases, these are TIR lenses 90, which are positioned on the rear side opposite the light-emitting surface of the respective cover 70, 80, bundle the light emitted by an LED in a known manner and emit it toward the underside in a directional manner. It is ideally provided that one lens 90 is used for each LED or LED cluster of the illuminants, wherein the LED or the associated LED cluster then engages in the recess 91 formed on the upper side of the lens 90. This arrangement of the lens 90 with respect to the associated LED, as well as the design of the lens 90, ensures that the light emitted by the LEDs in almost all directions is influenced in a desired manner and used for efficient light output.

In the variant of the cover 70 shown in FIGS. 13 to 15, it is provided that the lenses 90 are an integral part of the cover 70 and are integrally formed at the rear side thereof in a corresponding manner. In this case, the cover 70 is then preferably made consistently of the same translucent material, wherein it is nonetheless also conceivable to form those constituents through which light passes or which are intended to influence the light from a different material than the rest of the cover 70.

Figure 17:
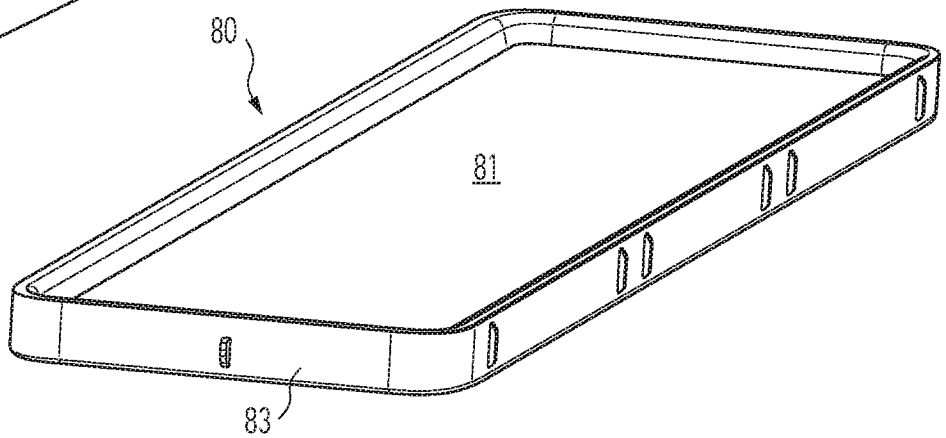
FIGS. 16 to 18 are views of a second variant of an optically effective cover.
Figure 16:
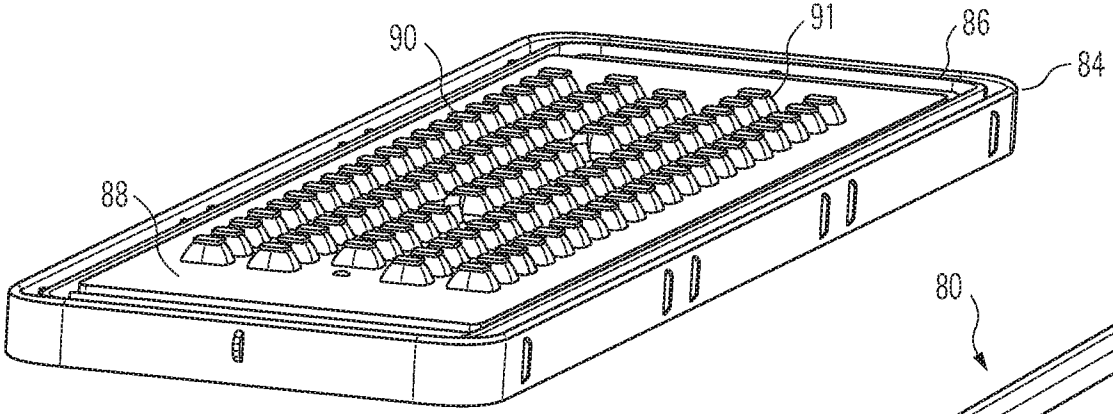
Figure 18:
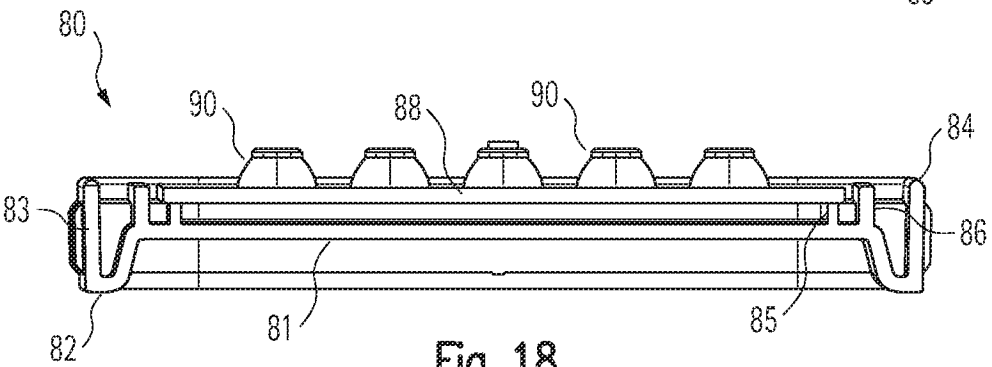

The variant shown in FIGS. 16 to 18, on the other hand, represents a particularly preferred embodiment for the cover 80, as the cover 80 now serves to additionally mount a separate component 88, which includes the lenses 90. For this purpose, the cover 80 has, on the rear side opposite the light output side, two peripheral webs 85 and 86, wherein the web 85 forms with its upper edge an annular support surface for the lens plate 88, and the somewhat higher peripheral web 86 laterally encompasses the plate 88 with a small amount of play. The advantage of this solution is that the lens plate 88 can move slightly laterally in comparison to the cover 80, or slight displacements are possible. This opens up the possibility that the sealing edge 84 of the cover 80 is permanently in contact with the seal 40 and the lens plate 88 can nonetheless also move along with the LEDs, where applicable. Temperature-related relative displacements can thereby be better absorbed, and a permanently correct positioning of the lenses 90 with respect to the LEDs is ensured. The correct alignment of the lenses 90 with respect to the LEDs can furthermore also be supported in that cone-like positioning pins or centering pins, which are not shown in more detail, are formed on the lens plate 88 and engage in corresponding openings of the LED board. For this purpose, corresponding bulges 28, 128, which allow the insertion of a corresponding centering pin but nonetheless do not hinder the planar support of the LED board on the accommodation region 25, 125, can be provided in the housing bottom 11, 111 of the luminaire housing 10, 110. Of course, such positioning elements can also be used in the cover 70 according to the first variant.

As already mentioned, the variant shown in FIGS. 16 to 18 represents a particularly preferred embodiment for the design of the cover 80 and of the associated optical system for influencing the light output. A further advantage of the mechanical decoupling between the cover 80 and the optical system 88 is that the optical system and the underlying LED boards are less susceptible to impact, and damage due to vibrations, e.g., during transport of the luminaire 1, can thus be avoided.

Of course, additional variations can also be carried out in the realization of the covers 70, 80. These variations relate, for example, to the design of the optical elements for influencing the light, wherein other refractive or light-scattering elements or structures could also be used as an alternative to the lenses 90 shown, for example. In particular, suitable prism structures or otherwise designed lenses that could also be arranged, where applicable, on the underside, i.e., the light-emitting surface of the cover, could also be considered. Furthermore, additional films could be inserted in order to influence the light output in the desired manner. In principle, the optical system can have optical materials such as scattering particles or conversion particles, optical structures such as a roughened surface, and/or optical elements such as lenses or a lens array.

The choice of the material can also be adapted to the desired light output, wherein a choice of the material that influences the color hue or the color temperature of the emitted light is in particular also conceivable. In the second variant, there is also the possibility of forming the cover 80 and the optical system 88 from different materials. In this case, a chemically particularly resistant material can then be selected in particular for the cover 80, whereas the optical system 88 is formed from a material that can be used in a particularly suitable manner for influencing the light.

Finally, it is also conceivable to design the cover 70 or 80 in such a way that it is an integral part of the holding element 50, 150. In particular, in the event that a separate lens plate 88 is again provided for influencing the light as in the variant of FIGS. 16 to 18, the advantage can nonetheless be achieved that, on the one hand, the accommodation chamber or the chamber for the LED illuminants is permanently enclosed in a sealing manner and, on the other hand, the lenses 90 are correctly positioned with respect to the LEDs.

A further function of the holding element 50, 150 and of the cover element 170 fastened thereto, where applicable, furthermore consists in enabling the flow of cooling air through the through-openings 30, 130 of the luminaire housing 10, 110. For this purpose, the holding element 50, 150 initially has openings 60, 160 corresponding to the through-openings 30, 130 of the housing 10, 110. The same applies to the cover element 100, wherein the openings 60 of the holding element 50 or the openings 185 of the cover element 170 are additionally respectively enclosed by peripheral webs 61, 186. These webs 61, 186 are oriented substantially transversely to the portion of the holding element 50 or of the cover element 170 comprising said webs, but in this case are aligned at a slight incline and lie flush at their upper side with the through-openings 30, 130 or 160 of the luminaire housing 10, 110 and, where applicable, of the holding element 150 so that cooling-air channels that extend slightly downward are formed which, as already mentioned, are formed on both sides of the accommodation region 20, 120 for the operating device.

The webs 61, 186 can delimit the through-openings 30, 130 of the luminaire housing 10, 110 laterally inward or outward and abut them in a preferred design. In this way, a corresponding splash protection can be provided so that no splash water enters into the space between the holding element 50, 150 and the cover 70 or 80, which would in particular be disadvantageous in the region of the seal 40. In order to nevertheless be able to discharge penetrating water, corresponding holes can, for example, be provided in the holding element 50, 150 and/or the cover element 170, and water can drain from this delimited space via said holes.

The thermal through-openings 30, 130 can likewise be peripherally curved inward or downward. As a result, the edges of the thermal through-openings 30, 130, which are in particular curved toward the holding element 50, 150, can form, with the aforementioned webs 61, 186 of the holding element 50 or of the cover element 170, a preferably continuous cooling-air channel and drainage channel that is closed at the edge. The cross-section of this channel is then designed in such a way that it initially tapers from the bottom to about half the height and then expands again.

The through-channels formed in the manner described above thus allow the flow of cooling air on the one hand but also the drainage of liquid on the other hand. As already mentioned, in the second variant, the rear side of the luminaire housing 110 is designed in such a way that no greater amount of liquid can accumulate there since said liquid either drains laterally via the housing wall 112 or is discharged downward via the through-channels. Again, the corresponding funnel-like design of the channels is advantageous because the channels initially taper toward the underside and, accordingly, the risk that the liquid draining downward will penetrate laterally into the sealing regions between the various components of the luminaire 1 is reduced.

A further particular feature of the second variant of the luminaire housing 110 is also the cooperation of the aforementioned cooling-air channels with the particularly designed surface of the luminaire housing 110. Namely, the result of the shape explained above is that the air flowing on the outside of the housing 110 from the bottom up will initially flow along the rear side of the housing 110 toward the central region. Here, this air will meet with the air that flows vertically upward through the cooling-air channels and has a relatively high speed due to the design of the channels and the resulting so-called Venturi effect. Ultimately, this results in an outward directed air swirl above the luminaire housing 110 on both sides of the central accommodation region 120 for the operating device. This air swirl not only provides particularly efficient dissipation of heat to the ambient air but also helps prevent the build-up of dust or dirt particles on the surface of the luminaire housing 110. Any necessary cleaning cycles for the luminaire 1 can thus be extended or prolonged, which is advantageous in that the luminaire 1 is usually not readily accessible due to its intended use and the resulting assembly.

In the cases described thus far, it has been assumed that the cooperation with the seal 40 is accomplished in that the corresponding rims or edges of the various covers penetrate into the seal 40, but are not connected thereto, so that removal of the holding element 50, 150 and the covers 70 or 80 is later possible again. However, it could also be provided that the sealing material is glued to the corresponding rims or edges, whereby the sealing effect can additionally be increased, where applicable. In this case, however, a later opening of the luminaire 1, e.g., for maintenance purposes, is only possible by destroying the seal 40.

As is clear from the above explanations, the luminaire housing, the holding element, where applicable in combination with the separate cover element, and the optical covers, always cooperate in a corresponding manner in order to realize a luminaire that on the one hand produces and emits a high amount of high-quality light and on the other hand is well protected against external influences. However, the respectively different variants of the housing, the holding element and the optical covers have different advantages with regard to their properties or the possibility of producing them, so that it may be advantageous, according to the respective area of use of the luminaire to select more expensive, higher-quality components or to use the more inexpensive variant. The decisive advantage of the solution according to the invention now consists in that the various variants of the three essential components (luminaire housing, holding element with optional separate cover element, and optical cover) can be combined in any manner and that easy assembly to form a luminaire is nonetheless made possible.

Figure 19:
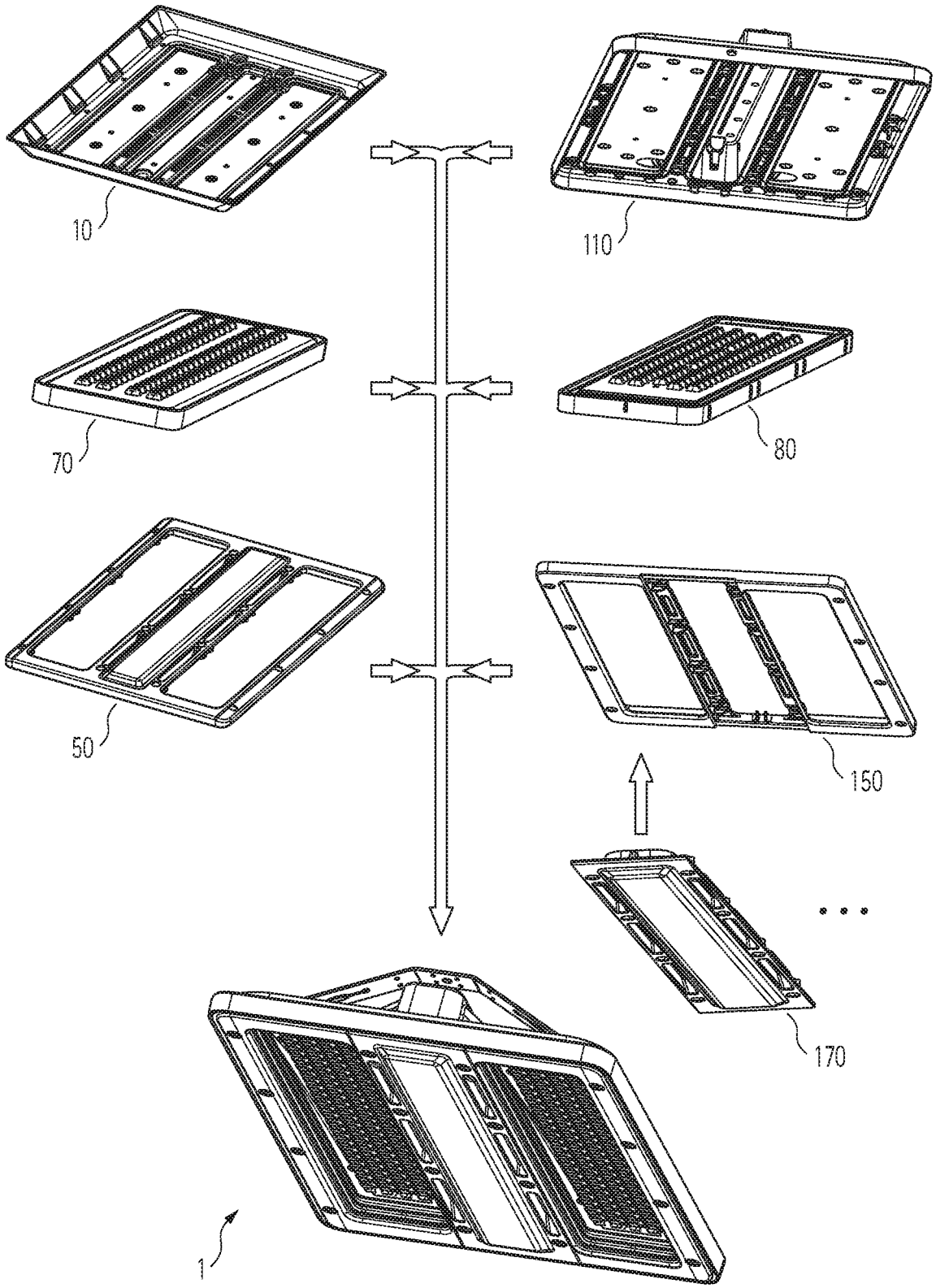
FIG. 19 is a schematic representation of the procedure for selecting the various available luminaire components in order to ultimately form a luminaire.

This idea is schematically shown in FIG. 19, wherein before the luminaire is assembled, a decision is thus first has to be made as to which of the two housing variants 10 or 110 is selected. Once this decision has been made, one of the two optical covers 70 or 80 can be selected according to the desired light-emitting properties and, where applicable, the required chemical resistance. Finally, the decision must be made as to whether the first variant of the holding element 50 with integrated cover for the accommodation region for the operating devices is selected or, alternatively thereto, the second variant 150, in which the separate cover element 170 is used as already mentioned, which in particular also enables easy opening of the region for the operating device. In this case, where applicable, it is possible to select again between different variants for the separate cover element 170, wherein the luminaire 1 is ultimately created from these three or four selected components. Of course, the LED boards as well as the corresponding operating devices are also to be mounted, although this is done independently of the selection of the aforementioned components of the kit. In that all components can be combined with one another in any way, a luminaire can thus be individually created that is precisely matched to the respective needs.

A further advantage of the solution according to the invention, which is to be emphasized at this point, is that the assembly of all relevant components of the luminaire takes place from one direction, namely from the underside or the light-emitting side of the housing. This applies to the arrangement of the seals and to the mounting of the illuminants, the operating components for operating the illuminants, and any connecting lines for the power supply of the illuminants. In principle, all of these components are introduced into the luminaire housing from the same direction, and it is not necessary to perform any additional work from the rear side. This is advantageous in that turning of the housing during the assembly of the luminaire is not required, which opens up the possibility of automating the assembly process to a large extent or even completely. The luminaire according to the present invention is thus not only characterized by its already described advantageous properties with regard to the light emission properties, the heat dissipation, and the resistance to external influences, but also has the advantage that the assembly of the luminaire can be carried out relatively easily.

The concept according to the invention can also be easily extended to other shapes or sizes of the luminaire. In doing so, there is in particular the possibility of increasing the number of chambers or spaces for accommodating operating devices or illuminants as desired. One option would be to realize a housing, for example, which has a total of four accommodation regions for illuminants as well as two, where applicable interconnected, accommodation regions for operating devices. Finally, this substantially corresponds to a doubling of the concept according to the invention shown in the figures, wherein it is only necessary to provide the housing as a whole in the extended form. All further components could then be used in the manner described above regardless of the number of accommodation regions used. In the described example, two identically designed holding elements with corresponding optical covers and cover elements are thus used, which are then arranged one behind the other in the longitudinal direction.

The invention claimed is:

1. A method for forming a luminaire (1), which has:

a trough-shaped luminaire housing (10) to which illuminants and an operating device for the illuminates are mounted, the trough-shaped luminaire having at least one region (25) for accommodating the illuminants, wherein each region (25) accommodating illuminants is surrounded by a seal (40) in a peripherally closed manner and the trough-shaped luminaire also having a further region (20, 120) for accommodating the operating device for the illuminants;

an optical cover (70, 80) for each at least one region accommodating the illuminants, wherein each optical cover spans the respective region (25, 125) accommodating the illuminants and abuts the respective seal (40) in a peripherally closed manner in order to form a closed space with the luminaire housing (10, 110), wherein the optical cover (70, 80) for region comprises an optical system for influencing the light of the respective illuminants, a frame-like holding element (50, 150), wherein the holding element (50, 150) is connected to the luminaire housing (10, 110) in such a way that it presses each cover (70, 80) into abutment with the seal (40), wherein the method of forming the luminaire comprises the following steps:

providing a group of at least two trough-shaped luminaire housings the (10, 110), wherein each trough-shaped luminaire housing in the group of at least two trough-shaped luminaire housings (10,100) have a different shape or are made of a different material from the other trough-shaped luminaire housings in the group of at least two trough-shaped luminaire housings;

providing a group of optical covers (70, 80), some optical covers in the group being made of a different material, having a different shape, and/or influencing light in a different manner, each optical cover being dimensionally compatible with each trough-shaped luminaire housings in the group of at least two trough-shaped luminaire housings;

providing a group of holding elements (50, 150), each holding element having a different shape or being made of a different material, and being dimensionally compatible with each of the trough-shaped luminaire housings in the group of at least two trough-shaped luminaire housings and each of the optical covers in the group of at least two optical covers;

selecting one trough-shaped luminaire housing (10, 110) from the group of at least two trough-shaped luminaire housings;

selecting one optical cover (70, 80) from the group of at least two covers for each region on the selected trough-shaped luminaire housing for illuminants;

selecting one holding element (50, 150) from the group of at least two holding elements; and assembling the luminaire using the selected trough-shaped luminaire housing, the selected at least one cover, and the selected holding element.

2. A kit for forming a luminaire (1), which has:

a group of at least two trough-shaped luminaire housing (10, 110), each trough-shaped luminaire housing having at least one region (25, 125) for accommodating illuminants and a further region for accommodating an operating device for the illuminants, wherein the at least one region (25, 125) for illuminants is surrounded by a seal (40) in a peripherally closed manner, said at least two trough-shaped luminaire housings being configured to mount the illuminants in the at least one region for illuminants and to mount the operating device in the further region for the operating device, wherein each trough-shaped luminaire housing in the group of at least two trough-shaped luminaire housings (10,100) have a different shape or are made of a different material from the other trough-shaped luminaire housings in the group of at least two trough-shaped luminaire housings;

a group of at least two optical covers (70, 80), each optical cover being configured to span one of the at least on region (25, 125) on the trough-shaped luminaire housings to accommodate illuminants and to abut the seal (40) in a peripherally closed manner in order to form a closed space with the luminaire housing (10, 110), wherein each cover (70, 80) comprises an optical system for influencing the light of the illuminants; and a group of at least two frame-like holding elements (50, 150), wherein each holding element (50, 150) is configured to connect to the luminaire housing (10, 110) in such a way that it presses the respective optical cover (70, 80) into abutment with the seal (40) and each holding element has a different shape or is made of a different material;

wherein each optical cover is dimensionally compatible with each trough-shaped luminaire housing in the group of at least two trough-shaped luminaire housings, and is dimensionally compatible with each of the trough-shaped luminaire housings in the group of at least two trough-shaped luminaire housings and dimensionally compatible with each of the optical covers in the group of at least two optical covers.

3. The kit according to claim 2, wherein a first variant of the luminaire housing (10) is formed as a deep-drawn sheet-metal part.

4. The kit according to claim 3, wherein a second variant of the luminaire housing (110) is formed as an aluminum die-cast part.

5. The kit according to claim 4, wherein in the second variant of the luminaire housing (110), substantially all surface regions of the luminaire housing (110) that form outer surfaces of the luminaire housing (110) are configured to enable the drainage of a liquid via an outside (112) of the housing wall (111) and/or an opening (130) formed in the luminaire housing (110).

6. The kit according to claim 2, wherein in a first variant of the optical cover (70), an optical lense (90) is an integral part of the cover (70).

7. The kit according to claim 6, wherein in a second variant of the cover (80), the optical lense (90) is held in a floating manner, as a separate component by the cover (80).

8. The kit according to claim 2, wherein the holding element (50, 150) comprises a further cover (52, 171), which is designed to cover the further region (20, 120) separately from the accommodation region (25, 125) for the illuminants.

9. The kit according to claim 8, wherein in a first variant, the further cover (52) is an integral part of the holding element (50).

10. The kit according to claim 9, wherein in a second variant, the further cover (171) can be detachably fastened as a separate cover element (170) to the holding element (150) by means of a screw connection.

11. The kit according to claim 10, wherein the cover element (170) can be detached from the holding element (150) in a state of said holding element fixed to the luminaire housing (10, 110).

12. The kit according to claim 10, wherein different cover elements (170) are available, which are curved differently.

13. The kit according to claim 2 wherein the mounting surfaces on the bottom surface of the trough-shaped luminaire for the illuminants and operating device are planar.

14. The method according to claim 2 wherein the mounting surfaces on the bottom surface of the trough-shaped luminaire for the illuminants and operating device are planar.

* * * * *